United States Patent [19]

Sasaki et al.

[11] Patent Number: 4,642,252

[45] Date of Patent: Feb. 10, 1987

[54] BODY FOR A PRESSURE-RESISTANT VESSEL

[75] Inventors: Hitoshi Sasaki; Shoji Igota, both of Kawasaki, Japan

[73] Assignee: Ajinomoto Co., Inc., Tokyo, Japan

[21] Appl. No.: 739,049

[22] Filed: May 29, 1985

[30] Foreign Application Priority Data

May 29, 1984 [JP] Japan ..... 59-107473

[51] Int. Cl.[4] ..... B65D 25/14; B65D 5/56

[52] U.S. Cl. ..... 428/35; 428/36; 428/910; 428/121; 220/453; 220/461; 220/414

[58] Field of Search ..... 220/1 BC, 3, 468, 90, 220/461, 453; 428/35, 36, 121, 910

[56] References Cited

U.S. PATENT DOCUMENTS

| | | | |
|---|---|---|---|
| 4,181,234 | 1/1980 | Heiremans et al. | 428/35 |
| 4,225,053 | 9/1980 | Naugle et al. | 220/416 |
| 4,379,014 | 4/1983 | Rausing | 428/480 |
| 4,590,126 | 5/1986 | Anderson | 428/35 |

*Primary Examiner*—Roland E. Martin
*Assistant Examiner*—James J. Seidleck
*Attorney, Agent, or Firm*—Oblon, Fisher, Spivak, McClelland & Maier

[57] ABSTRACT

A body for a pressure-resistant vessel comprising a spirally wound layer formed by a uniaxially stretched film of a crystalline high polymer, e.g., a can. The composite plastic cans according to this invention are useful for holding pressurized carbonated beverages.

13 Claims, 10 Drawing Figures

BODY FOR A PRESSURE-RESISTANT VESSEL

BACKGROUND OF THE INVENTION

1. Field of the Invention

This invention relates to a body for a composite plastic can having resistance to internal pressure which is suitable as, for example, a vessel, for holding carbonated drinks.

2. Discussion of Background

Cans capable of resisting internal pressure, for example, for holding a carbonated drink, have hitherto been made exclusively of metals.

Recently, an increased concern for environmental pollution caused by cans which are emptied and thrown away has developed. Another disadvantage of metal cans is their low efficiency of transportion. It is usually necessary to transport new and empty cans which occupy large space from one can manufacturing factory to another for use. Plastics are easy to mold and have, therefore, already been used for making various kinds of vessels. In the past, the manufacture of plastic cans was explored by the inventors of this invention as described in, for example, Japanese Laid-Open Patent Specifications Nos. 11146/1983, 153629/1983 and 209561/1983 and Laid-Open Utility Model Specifications Nos. 35315/1984 and 35333/1984.

In the past, conventional plastic cans have been unsatisfactory in view of their low resistant to internal pressure and were considered therefore to be unsuitable for holding carbonated drinks.

SUMMARY OF THE INVENTION

This invention provides a plastic can comprising a body having a simple means for imparting thereto a sufficiently high degree of internal pressure resistance as required of, for example, a vessel; for holding a carbonated drink, and which has a variety of advantages, including the ease of manufacture and disposal by, for example, incineration, which make it useful for large numbers of applications.

DETAILED DESCRIPTION OF THE INVENTION IN RELATION TO THE DRAWINGS

Figure 2:
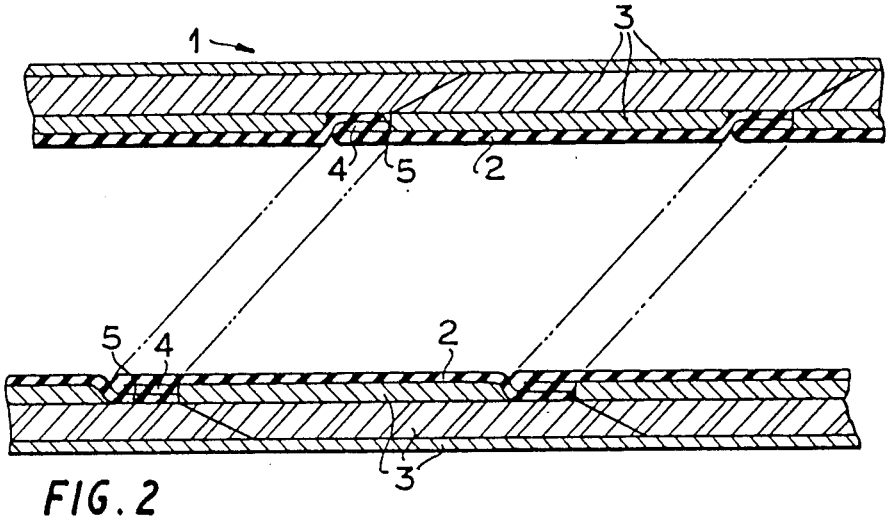
FIG. 2 is a partly omitted longitudinal sectional view of the body shown in FIG. 1.
Figure 1:
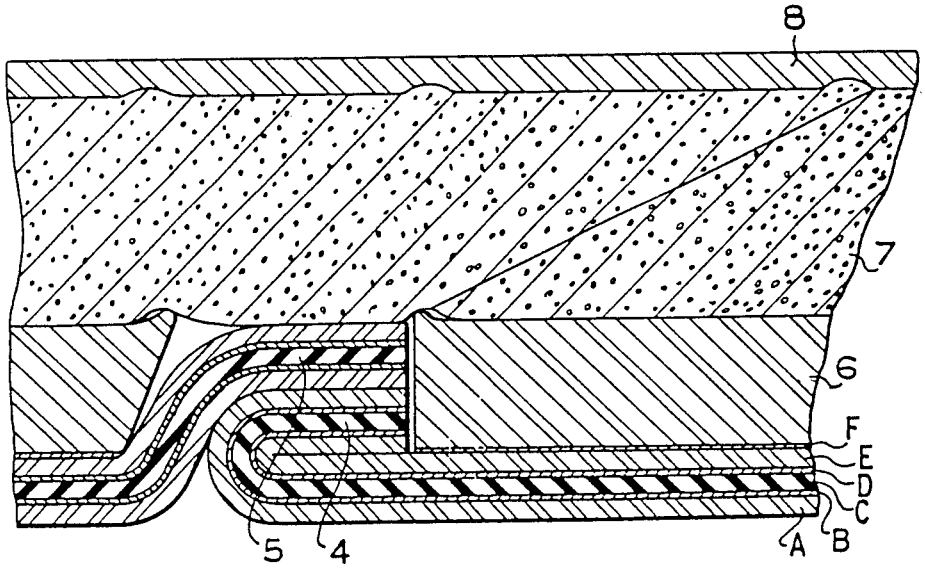
FIG. 1 is a fragmentary enlarged longitudinal sectional view of a cylindrical body for a composite plastic can embodying this invention.

FIGS. 1 and 2: Longitudinal section of a can

FIG. 2 is a fragmentary longitudinal sectional view showing by way of example a hollow cylindrical body 1 defining a can body embodying this invention and FIG. 1 is an enlarged view of a portion of FIG. 2.

The cylindrical body 1 comprises a layer 2 for protecting the contents of the can and a supporting layer 3 as shown in FIG. 2. The protecting layer 2 comprises an unstretched polypropylene layer A having a thickness of 70 μm, a carboxylic acid graft polypropylene adhesive layer B having a thickness of 7 μm, an aluminum foil C having a thickness of 9 μm, a urethane adhesive layer D having a weight of 4.5 g/m$^2$ and a uniaxially stretched polypropylene layer E having a thickness of 25 μm. The layers are disposed radially one outside another in the order of A to E, as shown in FIG. 1. The protecting layer 2 has one edge portion 4 folded back outwardly and another turn of the layer 2 has an adjacent edge portion 5 laid on, and bonded to, the edge portion 4.

The supporting layer 3 comprises a urethane adhesive layer F having a weight of 4.5 g/m$^2$, an unstretched polypropylene sheet 6 having a thickness of 200 μm and disposed between the folded and radially outwardly projecting edges 4 and 5 of the protecting layer 2, a plastic layer 7 composed of a mixture of polypropylene and calcium carbonate in a ratio of 1:1 and having a thickness of about 600 μm and a coating layer 8 of a polypropylene block copolymer having a thickness of 10 to 20 μm, which are disposed one radially outside another in the order of F, 6, 7 and 8.

The use of a uniaxially stretched film is not limited to the layer E, since it is, for example, possible to use a uniaxially stretched film for the sheet 6 or parts thereof 6, as well.

The above mentioned sheet 6 can be made by coating a melt extruded plastics material between projecting edges of the protecting layer 2.

Figure 3:
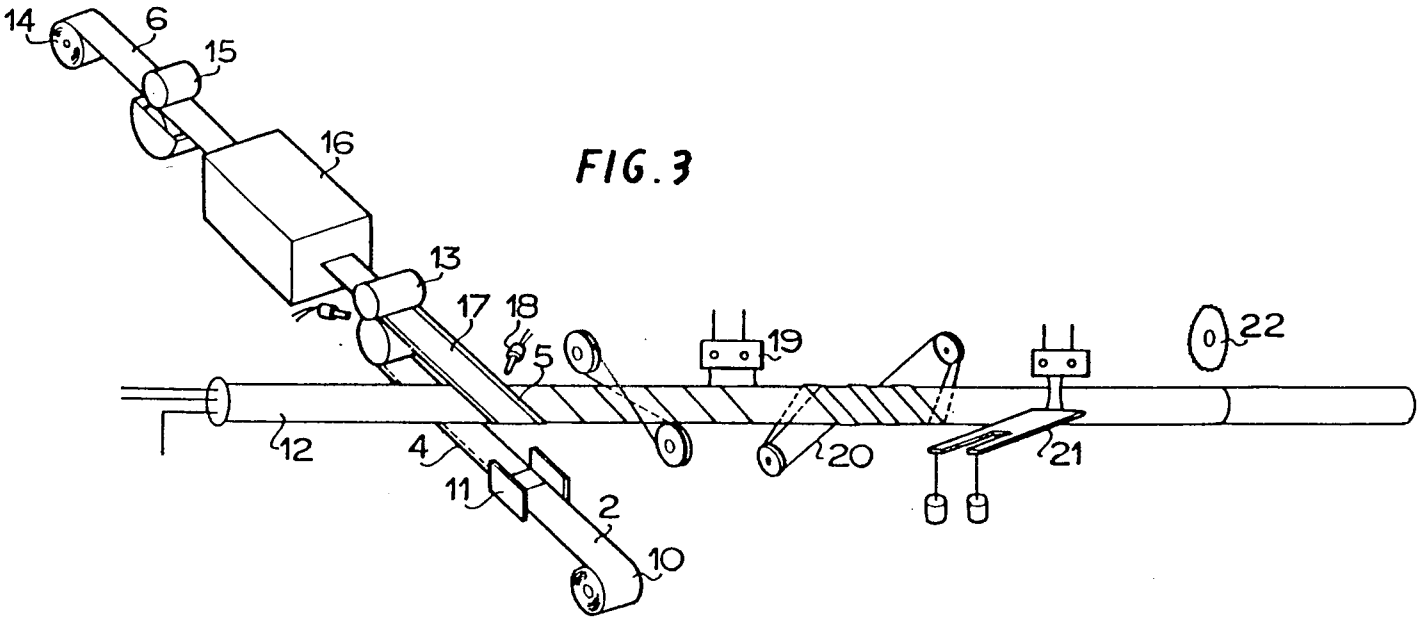
FIG. 3 is a schematic view showing by way of example an apparatus for making the cylindrical body of this invention.

FIG. 3: Apparatus for use in making the cylindrical body 1 is shown by way of example The unstretched polypropylene film A, aluminum foil C and uniaxially stretched polypropylene film E are bonded to one another by customary methods to form a laminated film 2. The film 2 forms a roll 10 in which the layer A is the outermost layer. The laminated film 2 unwound from the roll 10 is folded back at one edge 4 by a folding device 11 and conveyed below a mandrel 12 to a pair of contact bonding rolls 13. The sheet 6 is unwound from a roll 14 and an adhesive is applied to one surface of the sheet 6 by an applicator 15. The sheet 6 is conveyed through a hot air drier 16 and bonded to the film 2 by the contact bonding rolls 13 to form a laminated sheet 17. The laminated sheet 17 is wound about the mandrel 12 and the overlapping edges 4 and 5 thereof are bonded to each other by an air heater 18. A molten plastic is supplied by a T-die 19 to form the plastic layer 7 on the laminated sheet 17. The surface of the plastic layer 7 is smoothed by a smoothing belt 20 and a molten plastic is applied by a doctor knife 21 to form a smooth coating layer 8 on the surface of the plastic layer 7, whereby a tubular product is obtained. It is, then, cut by a cutter 22 into a plurality of cylindrical bodies having a specific length.

Figure 4:
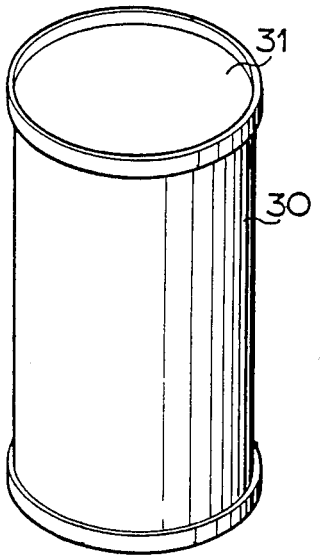
FIG. 4 is a perspective view of a can embodying this invention.

FIG. 4: Perspective view of a can

FIG. 4 is a perspective view showing by way of example a can having a body 50 formed by one of the cylindrical bodies 1 prepared as hereinabove described. The can has a cover 51 which may, for example, be a metal cover of the type used for a pressure-resistant vessel, and which can be provided with a device for opening the cover easily if required.

The can body of this invention is not limited to the embodiment hereinabove described. For example, it is possible to eliminate the folded edge 4 of the laminated film 2, depending on the substance which the can is used to hold. The can body may be a simpler structure comprising an inner layer, an intermediate layer and an outer layer. In this case, it is appropriate to form the intermediate layer from a unaxially stretched film. It is possible to add to these three layers a variety of other layers, such as a gas barrier layer or a layer imparting improved flexibility to the body, depending on the purpose for which the can is used.

DESCRIPTION OF THE INVENTION

The present invention relates to a layer formed by winding spirally a uniaxially stretched film of a crystalline high polymer. This is an extremely useful film since it has a very high strength and a small degree of elongation in the stretched direction.

More particularly, this invention relates to a body of a pressure-resistant vessel having a spiral layer formed by a uniaxially stretched film of a crystalline high polymer.

The term "crystalline high polymer" refers to, for example, polypropylene, high density polyethylene or nylon, among other polymers. Polypropylene is particularly preferred to make a vessel for holding a drink or food from the standpoint of hygiene and strength.

According to this invention, a uniaxially stretched film is formed from a crystalline high polymer and wound up. The thickness of the film depends on the kind and quality of the polymer used, the construction of the body to be made and the internal pressure resistance required. A sufficiently large number of samples may be prepared to find an appropriate thickness which gives satisfactory internal pressure resistance. Although the film can be applied to any portion of the body, it is generally desirable to place it in an intermediate layer where it can be protected against the influence of forces or events exterior to the body. The film is wound in the form of a tape, the length of which corresponds to the direction of its stretching. The film of this invention may be applied alone or with a film of another material laminated thereon. The present film does not necessarily need to cover the whole cylindrical surface of the body, and each turn thereof may be spaced apart from another.

The can, including the body of this invention, is useful for a variety of purposes without any particular limitations. It is, for example, suitable for holding a carbonated drink, such as a cola, cider or beer.

The uniaxially stretched film of a crystalline high polymer in the can body of this invention serves mainly to prevent it from expanding radially outwardly and thereby improve the internal pressure resistance of the can. The can body of this invention is highly resistant to internal pressure. According to this invention, it is easy to obtain a can body which can withstand an internal pressure of, say, up to and including 8 kg/cm$^2$.

This invention makes the composite plastic cans useful for an enlarged scope of application, including holding a pressurized substance. The plastic cans which have been emptied of their contents are easy to return and/or dispose of by incineration or otherwise. The cans may be manufactured in the same factory where they are actually used for packing purposes, thereby contributing to a reduction in the cost of transportation.

EXAMPLE 1

Figure 5:
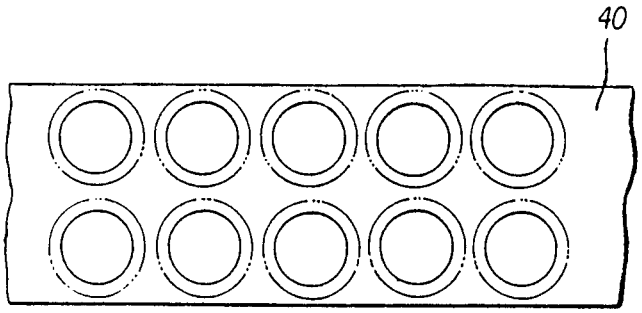
FIG. 5 shows a sheet of caps according to the invention.
Figure 6:
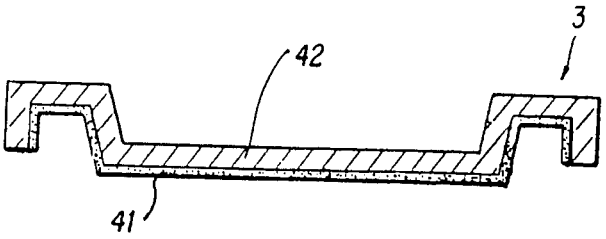
FIGS. 6 and 7 show pressure resistant caps according to the invention.
Figure 7:
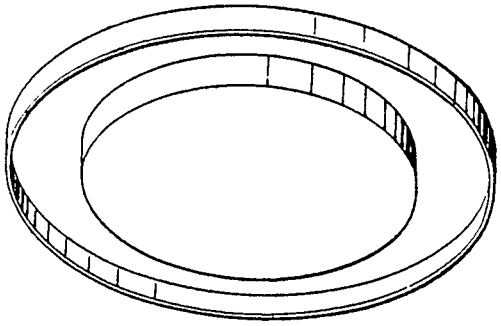

As shown in FIG. 1, the body member is made up of, from inside, a 70$\mu$ thick polypropylene layer A, a 7$\mu$ thick carboxylic acid-grafted polypropylene layer B, a 9$\mu$ thick aluminum foil C, a urethane-based adhesive layer D (4.5 g/m$^2$), a 25$\mu$ thick uniaxially stretched polypropylene layer E, a urethane-based adhesive layer F (4.5 g/m$^2$), a 200$\mu$ thick polypropylene layer 6, a 600$\mu$ thick 1:1 mixture layer 7 of polypropylene and calcium carbonate and a 10 to 20$\mu$ thick polypropylene block copolymer layer 8. A container consisting of this body member and a metal cap for a metal can is named as X and a container consisting of the body member where only a 25$\mu$ thick polypropylene layer is replaced for the 25$\mu$ thick uniaxially streched polypropylene layer E in the component of this body member and the metal cap for a metal can is named as Y. The metal cap used for those containers is made as follows. At first, 100 g of an average 6$\mu$ granule size carboxylic acid-grafted polypropylene is suspended in 1 liter of a 1:1 mixture solvent of solvesso-150 and cyclohexanone, and this suspension is coated onto 0.32 mm of aluminium plate as 3 to 5$\mu$ thickness as dry matter and the plate 40 is made as shown in FIG. 5. This plate 40 is dried and fixed by baking for 5 minutes at 200° C., then stamped out from the dotted line, and the pressure resistant cap is made as shown in FIGS. 6 and 7.

Figure 10:
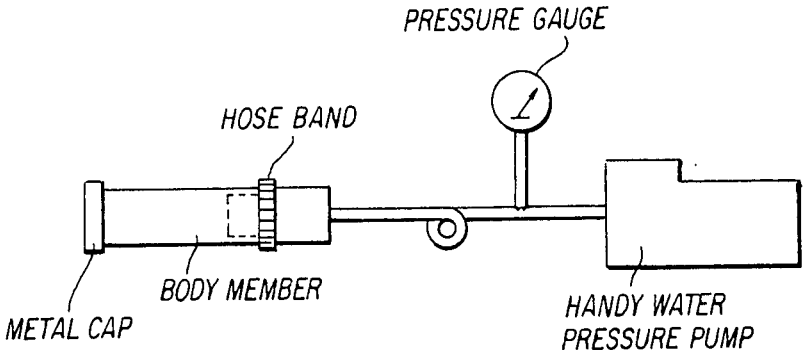
FIG. 10 is a scheme for measuring the inner pressure resistant strength of the containers according to the invention.

Then this metal cap is combined respectively with those body members for the X container and the Y container using a seamer for a metal can, and those metal caps are heated by the high frequency coil, and then cooled. The metal cap and body members are sealed tightly by the above means. Table 1 sets forth the inner pressure resistant strength of the X container (52.3 mm$\phi$) and the Y container (52.3 mm$\phi$). The measurement of the inner pressure resistant strength was conducted as indicated in the scheme of FIG. 10.

TABLE 1

| N | X container | Y container |
|---|---|---|
| 1 | 8.0 (kg/cm$^2$) | 5.5 (kg/cm$^2$) |
| 2 | 8.0 | 6.0 |
| 3 | 9.0 | 5.0 |
| 4 | 8.5 | 5.0 |
| 5 | 9.0 | 5.5 |
| 6 | 8.0 | 5.0 |
| 7 | 9.5 | 6.0 |
| 8 | 8.5 | 5.0 |
| 9 | 9.0 | 5.5 |
| 10 | 10.0 | 5.5 |
| Average | 8.8 | 5.4 |
| Standard Deviation | 0.68 | 0.37 |

The figure of the inner pressure resistant strength is dominated all by the destruction of those body members (X container and Y container).

EXAMPLE 2

Figure 8:
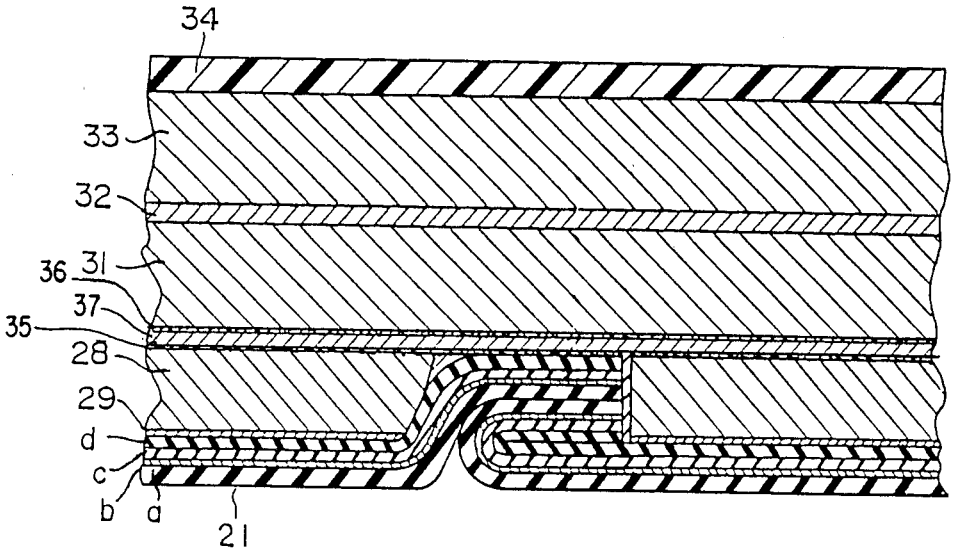
FIGS. 8 and 9 are fragmatory enlarged longitudinal sectional views of a cylindrical body for a composite plastic can embodying the invention.

As shown in FIG. 8, the body member is made up of, from inside, a 60μ thick low density polyethylene layer a, a urethane-based adhesive layer b (4.5 g/m$^2$), a 9μ thick aluminum foil c, a 25μ thick low density polyethylene layer d, a vinyl acetate-based adhesive layer 29, a 200μ thick paper sheet 28, a vinyl acetate-based adhesive layer 35, a 25μ thick uniaxially stretched polypropylene layer 37, a vinyl acetate-based adhesive layer 36, a 300μ thick paper sheet 31, a polyethylene (MI=50~100) adhesive layer 32, a 300μ thick paper sheet 33, a 10 to 20μ thick polyethylene (MI=50~100) layer 34. A container consisting of this body member and a metal cap for metal can is named as O.

Figure 9:
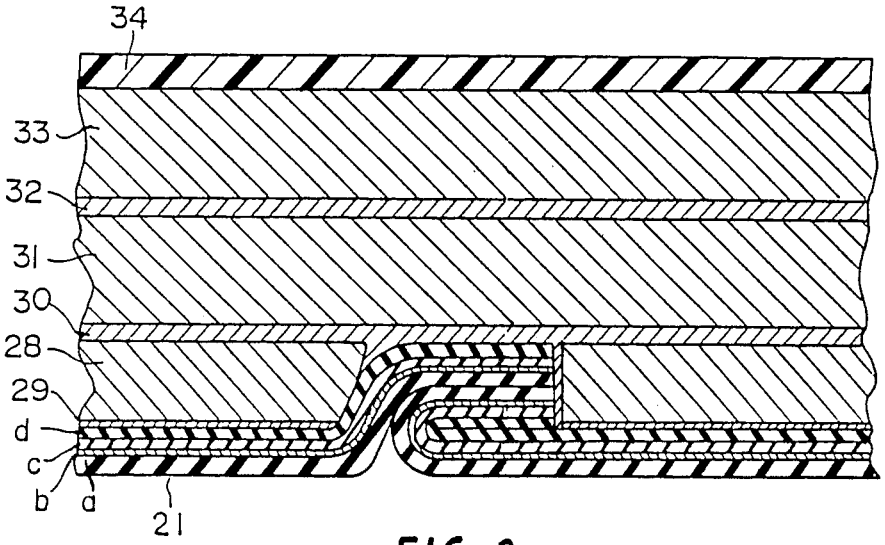

On the other side, as shown in FIG. 9, the body member is made up of, from inside, a 60μ thick low density polyethylene layer a, a urethane-based adhesive layer b (4.5 g/m$^2$), a 9μ aluminium foil c, a 25μ thick low density polyethylene layer d, a vinyl acetate-based adhesive layer 29, a 200μ thick paper sheet 28, a polyethylene (MI=50~100) adhesive layer 30, a 300μ thick paper sheet 31, a polyethylene (MI=50~100) adhesive layer 32, a 300μ thick paper sheet 33, a 10 to 20 μ thick polyethylene (MI=50~100) layer 34. A container consisting of this body member and a metal cap for metal can is named as p.

The metal cap used for these containers is made as follows. First, 100 g of the average 6μ granule size carboxylic acid-grafted polyethylene is suspended in 1 liter of 1:1 mixture solvent of solvesso-150 and cyclohexanone, as solution I. Then, 100 g of epoxyphenol is dissolved in 110 ml of a 6:3:1 mixture solvent of diacetonealcohol:solvesso-100:xylol, as solution II. 9 volumes of solution I and 1 volume of solution II are mixed uniformly. The mixed solution is coated to 0.32 mm of aluminium plate as 3 to 5μ thickness as dry matter and the plate 40 is made as shown in FIG. 5. Plate 40 is dried and fixed by baking for 5 minutes at 210° C., then stamped out from the dotted line, and the pressure resistant cap is made as shown in FIGS. 6 and 7.

This metal cap is then combined respectively with those body members for the O container and the p container using a seamer for metal cans, and the metal caps are heated by a high frequency coil and then cooled. The metal cap and body member are sealed tightly by those means. Table 2 sets forth the inner pressure resistant strength of the O container (52.3 mmϕ) and the p container (52.3 mmϕ). The measurement of the inner pressure resistant strength is carried out in a similar manner to Example 1.

TABLE 2

| N | O container | P container |
|---|---|---|
| 1 | 8.5 (kg/cm$^2$) | 5.5 (kg/cm$^2$) |
| 2 | 8.0 | 6.0 |
| 3 | 9.0 | 6.5 |
| 4 | 8.5 | 5.0 |
| 5 | 9.5 | 5.5 |
| 6 | 9.0 | 6.0 |
| 7 | 9.5 | 5.5 |
| 8 | 8.5 | 6.0 |
| 9 | 9.0 | 5.5 |

TABLE 2-continued

| N | O container | P container |
|---|---|---|
| 10 | 9.0 | 6.0 |
| Average | 8.9 | 5.8 |
| Standard Deviation | 0.47 | 0.42 |

The figure of the inner pressure resistant strength is dominated all by the destruction of those body members (O container and P container).

What is claimed as new and desired to be secured by Letters Patent of the United States is:

1. A pressure-resistant container having a body and metal ends which are high-frequency heat-sealed to the body, said body comprising a cylindrical body which serves as a content-protecting layer and an external shape-retention layer to keep the shape of the container, said content-protecting layer being constructed in such way that a laminate film including three layers comprising polyolefin/gas barrier/plastic is wound on a mandrel in such way that one side edge of the laminate film is folded back outward, with the polyolefin layer inside, and bonded in such way that air bubbles are not entrapped thereunder, and the other edge side of the laminate film is superimposed on and bonded to the folded part in such way that air bubbles are not entrapped between them, characterized in that said laminate film has a uniaxially stretched film of crystalline polymer on the outside of the plastic layer, and/or said shape-retention layer has a layer obtained by spirally winding a uniaxially stretched film of crystalline polymer, said metal ends being coated with at least one polymeric material selected from the group consisting of modified polyolefin, a mixture of modified polyolefin and epoxyphenol resin, and a mixture of modified polyolefin and epoxy-urea resin.

2. The container of claim 1 wherein the polymer is selected from the group consisting of polypropylene, polyethylene and nylon.

3. The container of claim 2 wherein the polyethylene is high density polyethylene.

4. The container of claim 1 wherein the film is in the form of a tape.

5. The container of claim 4 wherein the length of the tape corresponds to the direction of stretching.

6. The container of claim 1 wherein the vessel is a can.

7. The container of claim 1 wherein the body is hollow and cylindrical.

8. The container of claim 1, further comprising at least one adhesive layer applied thereon.

9. The container of claim 1, further comprising an aluminum foil layer.

10. The container of claim 1, further comprising an unstretched film of a polymer.

11. The container of claim 1, further comprising a gas barrier layer.

12. The container of claim 1, further comprising a paper layer.

13. The pressure-resistant container of claim 1 wherein the shape-retention layer is composed of either a melt extrusion coated resin layer or a layer composed of plastic-laminated cardboard hot-air heat-sealed to the body.

* * * * *